United States Patent [19]

Wernick

[11] Patent Number: 4,780,089

[45] Date of Patent: Oct. 25, 1988

[54] PLUG AND SOCKET COMBINATION FOR THE CONNECTION OF ELECTRICAL LAMPS AND EQUIPMENT

[75] Inventor: Rolf K. Wernick, Hanover, Fed. Rep. of Germany

[73] Assignee: Brufield Investments Limited, Weybridge, England

[21] Appl. No.: 76,268

[22] Filed: Jul. 22, 1987

[30] Foreign Application Priority Data

Jul. 23, 1986 [DE] Fed. Rep. of Germany ..... 3624875

[51] Int. Cl.[4] ..... H01R 13/625

[52] U.S. Cl. ..... 439/138; 439/144; 439/336

[58] Field of Search ..... 439/101, 102, 106, 107, 439/136–145, 332–337, 670–674, 531, 576

[56] References Cited

U.S. PATENT DOCUMENTS

| | | | |
|---|---|---|---|
| 3,112,973 | 12/1963 | Von Holtz | 439/337 |
| 3,339,171 | 8/1967 | Carlson | 439/140 |
| 3,392,362 | 7/1968 | Lipinski | 439/140 |
| 3,985,417 | 10/1976 | Fenton | 439/334 |
| 4,140,358 | 2/1979 | Marechal | 439/139 |
| 4,203,640 | 5/1980 | Bice et al. | 439/139 |
| 4,461,523 | 7/1984 | Ustin et al. | 439/139 |

FOREIGN PATENT DOCUMENTS

| | | | |
|---|---|---|---|
| 696549 | 10/1964 | Canada | 439/139 |
| 1590079 | 5/1970 | Fed. Rep. of Germany | 439/335 |

*Primary Examiner*—J. Patrick McQuade

[57] ABSTRACT

A plug and socket combination, in which a plug includes blade contacts positioned in a circle and projecting in an axial direction can be inserted into corresponding U-shaped contacts of the socket by turning the plug. Upon turning, the plug is coupled to the socket by a bayonet connection. A disc is positioned on a neutral contact bushing in the socket and the disc has slot apertures curved in a circular arc which correspond to the width and curvature of the blade contacts to permit insertion of the blade contacts into the slot apertures and turning of the blade contacts and disc.

15 Claims, 3 Drawing Sheets

PLUG AND SOCKET COMBINATION FOR THE CONNECTION OF ELECTRICAL LAMPS AND EQUIPMENT

BACKGROUND AND SUMMARY OF THE INVENTION

The invention concerns a combination of a plug and a socket for the connection of electrical lamps and electrical equipment, especially a combination which is also able to receive electrical power and which is suitable for all types of current.

A safety quick-connect unit for electrical lamps and equipment is shown in DE-OS No. 32 35 965. That unit consists of a plug and a socket, and the socket has a central, more or less cylindrical recess in which the electrical contacts are exposed, and into which a plug of corresponding cross-section can be inserted. The plug supports electrical contacts in the form of metal strips on its housing surface. A ground or neutral conductor is positioned in the center of both parts and the plug and the socket are connected by a bayonet connection.

This construction, however, has the serious disadvantage that in the central recess of the socket, the current-conducting contacts are exposed, so that inadvertent penetration with a finger can lead to an electrical shock and, thus, to injuries or burns. Accordingly, such a device represents a great danger for people, particularly for playing children, when the plug is removed. A further disadvantage is that the electrical connection with the socket or the contacts positioned on the socket is only able to be accomplished with difficulty, because the connection points are positioned outside and below the socket. Therefore, when for example the safety cap is removed or if the protective cap is damaged, the connection points are unsecured and can be damaged, and the insulation can also be damaged, so that dusting or other physical contact by the user ca result in the danger of injuries or burns.

The covering cap of the socket which is provided in this quick-fastening unit is changeable and is, therefore, relatively easy to remove.

In contrast the invention provides a plug and socket combination which is safe, can not lead to injuries from electrical shocks, is capable of compact construction, and in which all parts which conduct current or are electrically charged are protected against human contact and are accommodated in the housing of the combination. The combination in accordance with the invention is suited for all types of electrical devices, as well as for connections for surface and wall lamps, for plug and socket connections, for appliances such as standing lamps, pressing irons and the like and, because of the construction of the socket, can be advantageously used as a covered connecting socket which, when not in use, can be closed by a cap or a cover unit.

These advantages are achieved by way of a socket which comprises a body in which a bushing is centrally positioned which forms the neutral conductor and supports an axially movable, spring loaded disc with circularly arranged slot apertures positioned in a circle at a distance to each other. The apertures correspond to the current-conducting contacts in the body, which are surrounded and supported by a casing-shaped housing unit. The casing-shaped housing unit has groove-shaped recesses on its inside. The recesses accommodate projections on the plug for the purpose of phase-oriented electrical connection.

The circularly arranged slot apertures on the axially movable, spring loaded disc are preferably curved to correspond to the radius of the circle and align with correspondingly curved, U-shaped electrical metallic contacts, into which correspondingly curved blade-shaped contacts of the plug engage after penetrating the slot apertures of the disc during the rotation of the plug unit. A central bushing is formed coaxially to the casing of the body supporting the electrical contacts for the neutral conductor of the plug. The electrical contacts only first become operative during the further insertion and rotation of the plug. By rotating the plug, the circularly curved blade contacts enter into the corresponding U-shaped electrical contacts of the socket, whereby at the same time the projections on the plug which extend into the corresponding groove-shaped recesses of the socket housing reach a stop position, if a complete electrical contact is formed.

Due to the spring loading of the disc, the plug is finally pressed with its projections into corresponding depressions in the socket casing housing. These depressions are positioned laterally to the recesses so that a bayonet sealing connection results which prevents the removal of the plug. The removal of the plug is only possible if the plug is pressed into the socket, and then further turned for a certain angular range, which can amount to 30°–40°.

The body with the electrical connections, likewise, is essentially circular in shape and represents a plate to which the electrical connections are attached. It is attached together with the housing which surrounds the body with, for example screws, to a ceiling or a wall, if desired.

Through the attachment of different connections to the plug which are wider or thicker, confusion of the electrical phases is precluded so that the invention is also suitable for either alternating or direct current, or for serial connections and the like. The locking position or the position in which the plug can be removed from the socket, may be marked on the plug and on the plug socket.

The plug itself essentially comprises two parts, one of which is a bowl-shaped round part which corresponds to the internal diameter of the housing of the socket and the electrical clamping contacts are attached on its interior. The blade-shaped contacts, which project through the base of the bowl-shaped part extend from these. Rectangular projections are formed on the external circumference of the bowl which are more or less wide or thick in the circumferential direction. These projections ensure the locking and the correct phase connections, as described above.

The bowl-shaped part is covered by means of a cover with a boring for the passage of the cable. A clamping device may be positioned on or in the boring for the purpose of traction relief of the cable, as well as a suspension, for example, of a bracket or a joint for a lamp. The cover may be connected with the bowl-shaped part by screws.

If desired, the entire combination can be sealed with O-rings or thick disc so that it can also be used in damp areas.

BRIEF DESCRIPTION OF THE DRAWINGS

In the course of the description, the drawings will be referred to in which.

DESCRIPTION OF THE PREFERRED EMODIMENT

Figure 1:
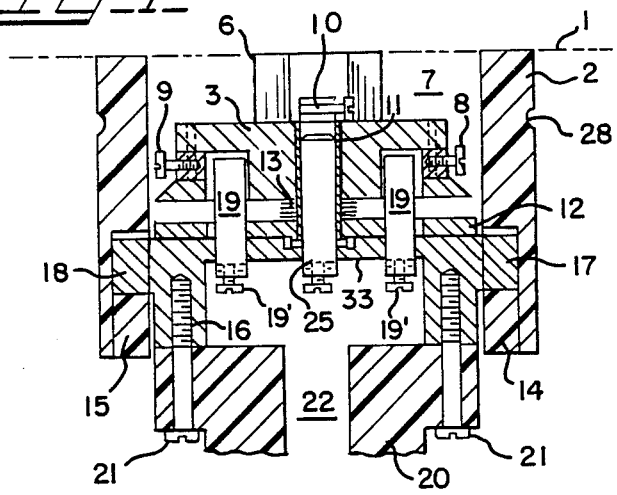
FIG. 1 is a cross-sectional schematic depiction of the construction and the interaction of the plug and socket combination.
Figure 3:
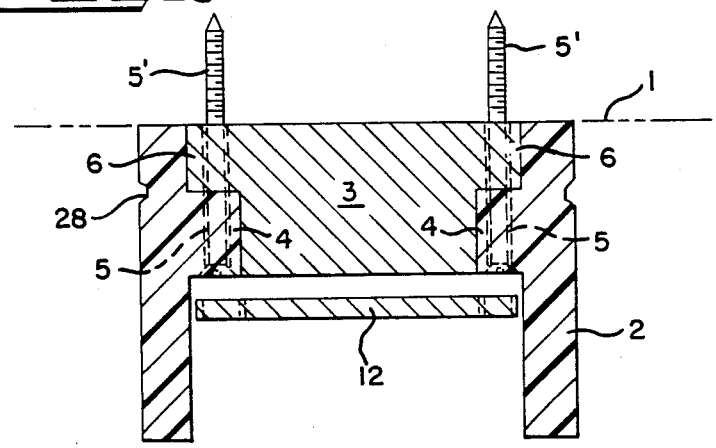
FIG. 3 is a schematic cross-sectional elevation view through the essential parts of the socket shown in FIG. 1, omitting the electrical contacts.

As shown in FIG. 1, surface 1 may be, for example, the ceiling or wall of a room. A socket into which the plug is inserted comprises a cylindrical housing 2 which surrounds and supports a body 3. As shown in FIG. 3, cylindrical housing 2 is provided with projections 4 with borings for screws 5 which align through two projections 6 lying opposite one another. Only one of the projections 6 is depicted i FIG. 1. The screws 5 extend through the projections 4 of the housing 2 and through the projections 6 of the body 3. The projections 6 form a space 7 located between the body 3 and the surface 1, as shown in FIG. 1, into which the electrical cable which can be connected with the socket may be positioned. The current-conducting leads are, depending on the type of current or circuit, connected in the usual manner with two or three contacts. These contacts are clamping contacts provided with screws 8 and 9, as shown in FIG. 1.

A clamp screw 10 accommodates the neutral conductor and is connected with a metallic bushing 11. The bushing 11 projects from the body 3 and supports a disc 12 on its external circumference. The disc 12 is spring loaded by a spring 13 in such a manner that the disc 12 is urged downwardly as viewed in FIG. 1.

Figure 2:
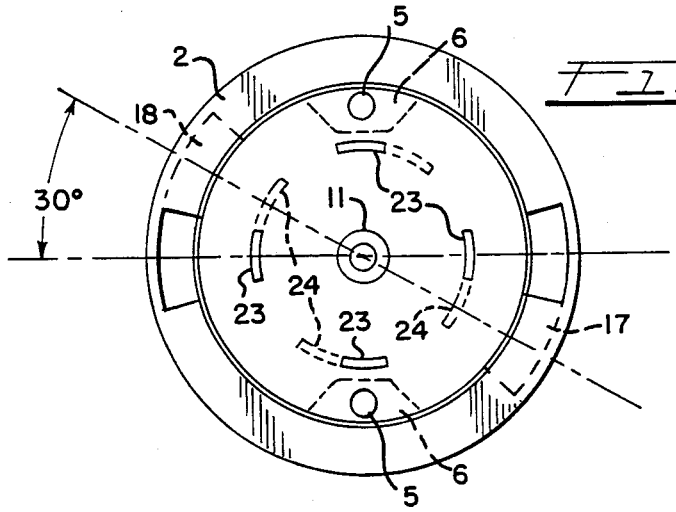
FIG. 2 is a schematic view from below of the socket which accommodates the plug.

As shown in FIG. 1, the housing 2 has two groove-shaped recesses 14 and 15 opposite one another. As shown in FIG. 2, these recesses 14 and 15 are elongated in the direction of the circumference of the housing 2 so that two projections 17 and 18 positioned on the plug casing 16 can be inserted into these recesses. The spring which presses against the plug casing 16 through the disc 12, causes the projections 17 and 18 to catch on the bayonet lock after the plug is rotated through an angle of 30°-40°.

The plug itself or its casing contains four blade contacts 19 positioned in circular fashion and having clamping connections 19'. The plug casing has a bowl-shaped form and is covered by a cover 20 which is attached to the casing by means of screws 21. A passage 22 for an electrical cable (not shown) is provided which leads to a lamp or other appliance.

As shown in FIG. 2, four curved slotted apertures 23 are positioned in the disc 12. The curvature of slotted apertures 23 corresponds to the circular radius on which these slotted apertures or the blade contacts 19 lie. Represented in dotted lines in FIG. 2 are electrical contacts 24 which are connected to the clamping connections 8 and 9, and with which the blade contacts 19 engage. In the center of the plug a pin 25 is positioned to engage the bushing 11 and the pin 25 is connected with the neutral conductor (not shown).

Figure 4:
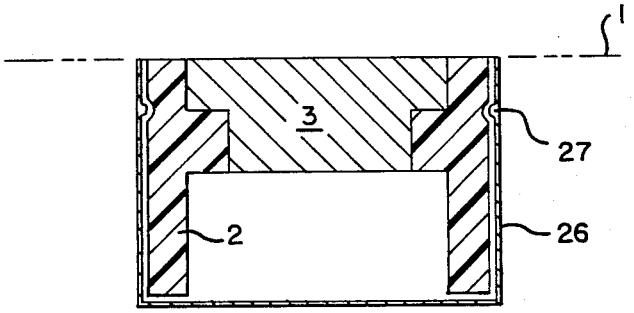
FIG. 4 is a view of the cover of an unused socket positioned on a surface in a room.

The plug socket of FIG. 3 is shown in FIG. 4 attached to the ceiling or wall of a room. It is covered by a cap 26 when not in use. The cap 26 is supported by means of a snap fastener 27 which comprises a circular or punched elevation on the inner side which engages in a corresponding recess 28 in the housing 2.

Figure 5:
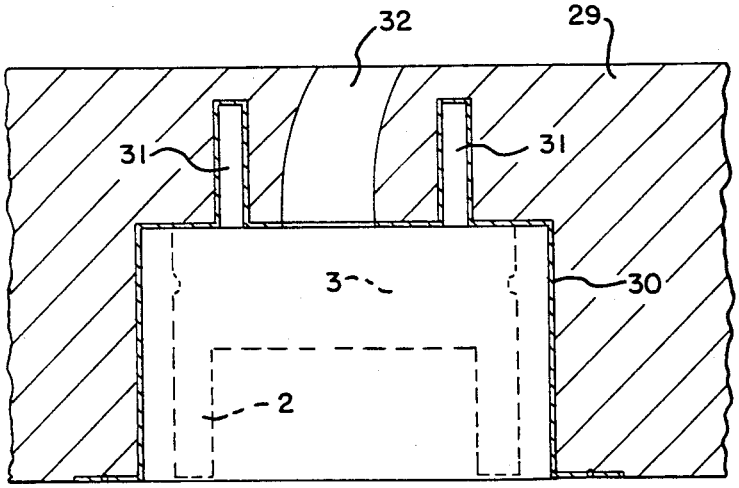
FIG. 5 is a view of the installation of the socket in a concealed position, for example, in the ceiling of a room.

The plug socket in accordance with FIG. 3 is shown in FIG. 5 positioned in a cover or material layer 29 using a built-in socket 30 with conical or tubular attachments 31 into which the attachment screws 5 engage. This concealed construction, when not in use, can be covered or sealed. A cable feed channel 32 is shown in FIG. 5.

With reference to the drawings, the plug and socket combination of the invention operates in the following manner.

The socket which is depicted in a simplified manner and with other aspects in FIGS. 2 and 3, can be screwed to the ceiling, wall or floor of a room by for example screws 5'. The electrical lines are accommodated within the housing 2 and, because of the distance between the surface 1 and the body 3 due to the projections 6, these can easily be accommodated after attachment to the clamping contacts 8 and 9 inside the housing 2. The socket is now ready to accommodate the plug.

The disc 12 is supported in an axially movable manner and loaded by the spring 13 on the central bushing 11. It contains only circularly curved slot apertures, as described above, in such a number as corresponds to the number of the contracts provided. The disc can rotate on the bushing 11 over an angle of 30°, as shown in FIG. 2. Any danger from unintended contact with the current-conducting contacts is thus prevented. The plug consists of the bowl-shaped plug casing 16, likewise of circular shape, and somewhat smaller in diameter than the internal diameter of the socket housing 2.

The blade-shaped, slightly curved contacts 19 are attached in an aligned manner in the base 33 of the plug casing 16 with the contacts 24 of the socket, whereby the clamping connections 19 lie in the interior of the bowl-shaped casing. Thereby the contacts are covered by the cover 20 which is supported by screws 21.

During the connection of the plug, the pin 25 to which the neutral conductor is connected, first is inserted in the open end of the bushing 11. During the further insertion of the plug, the external surface of the bowl-shaped plug casing 16 moves the disc 12 which can only be turned over a limited angular range, so that the blade-shaped contacts 19 finally enter into engagement with the electrical contacts 24 through the slot apertures 23 of the disc. When the plug is rotated by the limited angular amount, the disc is carried along and the projections 17 of the plug casing 16 enter into the lateral recesses. When the plug is released, the projections 17 lie behind corresponding depressions in the housing 2, and expansion of the spring 13 results in a bayonet seal.

Suspension devices, joints, or the like which can be stressed by traction and on which, for example, a lamp can be suspended, can be positioned on the cover 20 with the cable passage 22. The more or less cylindrical form of the combination in accordance with the invention can be covered with a decoratively shaped, bowl-shaped cover attached to the lamp as is also the case with normal connections by means of porcelain insulators.

The representation in FIG. 3 is only schematic in order to demonstrate the type of attachment of the body 3 which supports the electrical connections in combination with housing and the socket, such as, for example, on the ceiling of a room. The body 3 has the shape shown in FIG. 1.

What I claim is:

1. A combination of a plug and socket for the connection of electrical lamps and equipment with a bayonet connection between the plug and the socket, wherein the socket comprises a body; a bushing in said body attached in the center thereof, said bushing defining a neutral conductor; an axially movable, spring loaded disc on said bushing, said disc having circularly shaped slot apertures positioned at a distance to one another; current-conducting contacts in the body positioned adjacent said apertures; a casing-shaped housing supporting said body, said housing having groove-shaped recesses in the interior thereof; and projections on said plug receivable and movable in said recesses for the phase-oriented connection of said plug and socket.

2. The combination of claim 1, wherein said slot apertures and said contacts in the body of the socket align with one another, and accommodate blade contacts on said plug.

3. The combination of claim 1, wherein said disc is rotatable on said bushing by an amount to permit the locking of said projections on said plug in said recesses to form a bayonet seal.

4. The combination of claim 2, wherein said disc is rotatable on said bushing by an amount to permit the locking of said projections on said plug in said recesses to form a bayonet seal.

5. The combination of claim 1, wherein said body of the socket includes at least one projection for positioning said body in spaced relationship to a surface upon which the combination is mounted.

6. The combination of claim 2, wherein said body includes at least one projection for positioning said body in spaced relationship to a surface upon which the combination is mounted.

7. The combination of claim 3, wherein said body of the socket includes at least one projection for positioning said body in spaced relationship to a surface upon which the combination is mounted.

8. The combination of claim 1, wherein said plug comprises a casing having a bowl-shaped form; blade contacts in said casing; a pin in said casing positioned to contact said bushing; connection means in the interior of said plug casing for connection of leads to said casing contacts and said pin; and a cover on said casing having a passage for said leads.

9. The combination of claim 2, wherein said plug comprises a casing having a bowl-shaped form; blade contacts in said casing; a pin in said casing positioned to contact said bushing; connection means in the interior of said plug casing for connection of leads to said casing contacts and said pin; and a cover on said casing having a passage for said leads.

10. The combination of claim 3, wherein said plug comprises a casing having a bowl-shaped form; blade contacts in said casing; a pin in said casing positioned to contact said bushing; connection means in the interior of said plug casing for connection of leads to said casing contacts and said pin; and a cover on said casing having a passage for said leads.

11. The combination of claim 5, wherein said plug comprises a casing having a bowl-shaped form; blade contacts in said casing; a pin in said casing positioned to contact said bushing; connection means in the interior of said plug casing for connection of leads to said casing contacts and said pin; and a cover on said casing having a passage for said leads.

12. The combination of claim 8, including means on said cover for suspending an electrical appliance therefrom.

13. The combination of claim 9, including means on said cover for suspending an electrical appliance therefrom.

14. The combination of claim 10, including means on said cover for suspending an electrical appliance therefrom.

15. The combination of claim 11, including means on said cover for suspending an electrical appliance therefrom.

* * * * *